US010347210B2

(12) United States Patent
Guo et al.

(10) Patent No.: US 10,347,210 B2
(45) Date of Patent: Jul. 9, 2019

(54) DRIVING METHODS AND DRIVING DEVICES OF DISPLAY PANELS

(71) Applicant: Wuhan China Star Optoelectronics Technology Co., Ltd., Wuhan, Hubei (CN)

(72) Inventors: Xingling Guo, Guangdong (CN); Chun-Hung Huang, Guangdong (CN); Xiaoping Tan, Guangdong (CN); Jiehui Qin, Guangdong (CN)

(73) Assignee: Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 114 days.

(21) Appl. No.: 15/325,081

(22) PCT Filed: Jan. 7, 2017

(86) PCT No.: PCT/CN2017/070529

§ 371 (c)(1),
(2) Date: Jan. 9, 2017

(87) PCT Pub. No.: WO2018/113049

PCT Pub. Date: Jun. 28, 2018

(65) Prior Publication Data

US 2018/0226053 A1 Aug. 9, 2018

(51) Int. Cl.
*G09G 5/02* (2006.01)
*G09G 5/10* (2006.01)
(Continued)

(52) U.S. Cl.
CPC ..... *G09G 5/02* (2013.01); *G09G 3/3406* (2013.01); *G09G 3/3611* (2013.01); *G09G 5/10* (2013.01);
(Continued)

(58) Field of Classification Search
CPC ..... G09G 2340/06; G09G 2320/062; G09G 2320/0626; G09G 2320/064;
(Continued)

(56) References Cited

U.S. PATENT DOCUMENTS

2005/0057485 A1* 3/2005 Diefenbaugh ..... G09G 3/3406 345/102
2008/0094383 A1* 4/2008 Stessen ..... G09G 3/3406 345/209

(Continued)

*Primary Examiner* — Dong Hui Liang
(74) *Attorney, Agent, or Firm* — Andrew C. Cheng

(57) ABSTRACT

The present disclosure relates to a driving method and a driving device of display panels. The driving method includes: dividing a saturation interval of an original image frame to be displayed by a display panel into a plurality of sub-saturation intervals; obtaining saturation values corresponding to each of the pixels in the original image frame; calculating numbers of pixels in the original image frame falling within each of the sub-saturation intervals in accordance with the saturation values corresponding to each of the pixels. In this way, the backlight brightness outputted by the backlight module may be adjusted in accordance with the saturation values of the original image frame so as to enhance the low brightness issue when a pure-color image is displayed by the display panel configured with RGBW sub-pixels.

3 Claims, 2 Drawing Sheets

(51) Int. Cl.
*G09G 3/34* (2006.01)
*G09G 3/36* (2006.01)

(52) U.S. Cl.
CPC ..... *G09G 2300/0452* (2013.01); *G09G 2320/064* (2013.01); *G09G 2320/0626* (2013.01); *G09G 2320/0666* (2013.01)

(58) Field of Classification Search
CPC ... G09G 2320/0633; G09G 2320/0646; G09G 2320/0653; G06G 2320/062; G06G 2320/0626; G06G 2320/064; G06G 2320/0633; G06G 2320/0646; G06G 2320/0653
See application file for complete search history.

(56) References Cited

U.S. PATENT DOCUMENTS

2012/0154451 A1* 6/2012 Kao ..... G09G 5/10 345/690
2016/0035289 A1* 2/2016 Inada ..... G09G 3/3406 345/690
2016/0247460 A1* 8/2016 Kim ..... G09G 3/3413

* cited by examiner

DRIVING METHODS AND DRIVING DEVICES OF DISPLAY PANELS

BACKGROUND OF THE INVENTION

1. Field of the Invention

The present disclosure relates to liquid crystal display technology, and more particularly to a driving method and a driving device of display panels.

2. Discussion of the Related Art

Currently, RGB display panels includes a pixel cell array, wherein each of the pixels may include a red (R), a green (G), and a blue (B) sub-pixel cells. With the technical development, a white (W) sub-pixel cell may be also configured except for the R, G, B sub-pixel cells so as to form a RGBW display panel. By configuring the W sub-pixel cell, the pixel cell may include high transmission rate so as to reduce the power consumption of the display panel. However, as the total dimension of the RGB display panel remains the same regardless of the four sub-pixel cells (R, G, B, W) or the three sub-pixel cells (R, G, B) are configured, that is, the dimension of the four sub-pixel cells (R, G, B, W) is only ¼ of the total dimension, and the dimension of the three sub-pixel cells (R, G, B) is ⅓ of the total dimension. As such, the aperture rate of the display panel configured with the R, G, B, W sub-pixel cells ("RGBW display panel") is about 75% of the normal display panel configured with the R, G, B sub-pixel cells ("RGB display panel"). When a pure-color image is displayed, the brightness of the RGBW display panel is lower than that of the RGB display panel, and the displayed image is darker. In addition, as the W sub-pixel cell is configured, the contrast of the image may be higher. When the user views the pure-color image, the user may feel that the pure-color image may be darker due to the higher contrast.

SUMMARY

The present disclosure relates to a driving method and a driving device of display panels for enhancing the darker brightness issue when the pure-color image is displayed by the RGBW display panel.

In one aspect, a driving method of display panels include: dividing a saturation interval of an original image frame to be displayed by a display panel into a plurality of sub-saturation intervals; obtaining saturation values corresponding to each of the pixels in the original image frame; calculating numbers of pixels in the original image frame falling within each of the sub-saturation intervals in accordance with the saturation values corresponding to each of the pixels; obtaining an original enhanced coefficient corresponding to the original image frame in accordance with the enhanced coefficient corresponding to the numbers of the pixels within the sub-saturation interval; adjusting a first backlight controlling coefficient generated by a pulse width module (PWM) unit in accordance with the original enhanced coefficient; weighting the adjusted first backlight controlling coefficient and a second backlight controlling coefficient generated by the Content Adaptive Brightness Control (CABC) unit, and outputting the first backlight controlling coefficient and the second backlight controlling coefficient to a backlight module to control a displayed image; wherein the step of obtaining the saturation values corresponding to each of the pixels in the original image frame further includes: calculating the saturation value corresponding to each of the pixels in accordance with the equation:

$$s = \frac{\mathrm{Max}(R1, G1, B1) - \mathrm{Min}(R1, G1, B1)}{\mathrm{Max}(R1, G1, B1)};$$

Wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1);

wherein the step of weighting the adjusted first backlight controlling coefficient and a second backlight controlling coefficient generated by the CABC unit, and outputting the first backlight controlling coefficient and the second backlight controlling coefficient to a backlight module to control a displayed image further includes: adopting a product of the adjusted first backlight controlling coefficient and the second backlight controlling coefficient generated by the CABC unit to be a third backlight controlling coefficient; determining whether the third backlight controlling coefficient is smaller than 100%; outputting the PWM signals having the duty cycle ratio equaling to the third backlight controlling coefficient to the backlight module upon determining the third backlight controlling coefficient is smaller than 100%; and outputting the PWM signals having the duty cycle ratio equaling to 100% to the backlight module upon determining the third backlight controlling coefficient is greater than 100%.

Wherein the step of obtaining an original enhanced coefficient corresponding to the original image frame in accordance with the enhanced coefficient corresponding to the numbers of the pixels within the sub-saturation interval further includes: adopting the enhanced coefficient corresponding to the sub-saturation interval having the greatest number of pixels as the original enhanced coefficient.

Wherein the step of obtaining an original enhanced coefficient corresponding to the original image frame in accordance with the enhanced coefficient corresponding to the numbers of the pixels within the sub-saturation interval further includes: obtaining a weight corresponding to each of the sub-saturation intervals in accordance with the number of pixels falling within each of the sub-saturation intervals; and obtaining the original enhanced coefficient in accordance with the weight and the enhanced coefficient corresponding to each of the sub-saturation intervals.

In another aspect, a driving method of display panels include: dividing a saturation interval of an original image frame to be displayed by a display panel into a plurality of sub-saturation intervals; obtaining saturation values corresponding to each of the pixels in the original image frame; calculating numbers of pixels in the original image frame falling within each of the sub-saturation intervals in accordance with the saturation values corresponding to each of the pixels; obtaining an original enhanced coefficient corresponding to the original image frame in accordance with the enhanced coefficient corresponding to the numbers of the pixels within the sub-saturation interval;

adjusting a first backlight controlling coefficient generated by a pulse width module (PWM) unit in accordance with the original enhanced coefficient; and weighting the adjusted first backlight controlling coefficient and a second backlight controlling coefficient generated by the CABC unit, and outputting the first backlight controlling coefficient and the second backlight controlling coefficient to a backlight module to control a displayed image.

Wherein the step of obtaining the saturation values corresponding to each of the pixels in the original image frame further includes: calculating the saturation value corresponding to each of the pixels in accordance with the equation:

$$s = \frac{\mathrm{Max}(R1, G1, B1) - \mathrm{Min}(R1, G1, B1)}{\mathrm{Max}(R1, G1, B1)};$$

wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

Wherein the step of obtaining an original enhanced coefficient corresponding to the original image frame in accordance with the enhanced coefficient corresponding to the numbers of the pixels within the sub-saturation interval further includes: adopting the enhanced coefficient corresponding to the sub-saturation interval having the greatest number of pixels as the original enhanced coefficient.

Wherein the step of obtaining an original enhanced coefficient corresponding to the original image frame in accordance with the enhanced coefficient corresponding to the numbers of the pixels within the sub-saturation interval further includes: obtaining a weight corresponding to each of the sub-saturation intervals in accordance with the number of pixels falling within each of the sub-saturation intervals; and obtaining the original enhanced coefficient in accordance with the weight and the enhanced coefficient corresponding to each of the sub-saturation intervals.

Wherein the step of weighting the adjusted first backlight controlling coefficient and a second backlight controlling coefficient generated by the CABC unit, and outputting the first backlight controlling coefficient and the second backlight controlling coefficient to a backlight module to control a displayed image further includes: adopting a product of the adjusted first backlight controlling coefficient and the second backlight controlling coefficient generated by the CABC unit to be a third backlight controlling coefficient; determining whether the third backlight controlling coefficient is smaller than 100%; outputting the PWM signals having the duty cycle ratio equaling to the third backlight controlling coefficient to the backlight module upon determining the third backlight controlling coefficient is smaller than 100%; and outputting the PWM signals having the duty cycle ratio equaling to 100% to the backlight module upon determining the third backlight controlling coefficient is greater than 100%.

In another aspect, a driving device of display panels includes: a division module is configured to divide a saturation interval of an original image frame to be displayed by a display panel into a plurality of sub-saturation intervals; a first obtaining module is configured to obtain saturation values corresponding to each of the pixels in the original image frame; a statistic module connects to the division module and the first obtaining module, and the statistic module is configured to calculate numbers of the pixels in the original image frame falling within each of the sub-saturation intervals in accordance with the saturation values corresponding to each of the pixels obtained by the first obtaining module; a second obtaining module connects to the statistic module, and the second obtaining module is configured to obtain an original enhanced coefficient corresponding to the original image frame in accordance with the enhanced coefficient corresponding to the numbers of the pixels within the sub-saturation intervals calculated by the statistic module; an adjustment module connects to the second obtaining module, and the adjustment module is configured to adjust a first backlight controlling coefficient generated by a PWM unit in accordance with original enhanced coefficient obtained by the second obtaining module; and a processing module connects to the adjustment module, and the processing module is configured to weight the adjusted first backlight controlling coefficient and a second backlight controlling coefficient generated by a CABC unit, and output the first backlight controlling coefficient and the second backlight controlling coefficient to a backlight module to control a displayed image.

Wherein the step of obtaining the saturation values corresponding to each of the pixels in the original image frame executed by the first obtaining module further includes:

calculating the saturation value corresponding to each of the pixels in accordance with the equation:

$$s = \frac{\mathrm{Max}(R1, G1, B1) - \mathrm{Min}(R1, G1, B1)}{\mathrm{Max}(R1, G1, B1)};$$

Wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

Wherein the step of obtaining an original enhanced coefficient corresponding to the original image frame in accordance with the enhanced coefficient corresponding to the number of the pixels within the sub-saturation intervals executed by the second obtaining module further includes: adopting the enhanced coefficient corresponding to the sub-saturation interval having the greatest number of pixels as the original enhanced coefficient.

Wherein the step of obtaining an original enhanced coefficient corresponding to the original image frame in accordance with the enhanced coefficient corresponding to the number of the pixels within the sub-saturation intervals executed by the second obtaining module further includes: obtaining a weight corresponding to each of the sub-saturation intervals in accordance with the number of pixels falling within each of the sub-saturation intervals by the second obtaining module; and obtaining the original enhanced coefficient in accordance with the weight and the enhanced coefficient corresponding to each of the sub-saturation intervals.

Wherein the step of weighting the adjusted first backlight controlling coefficient and a second backlight controlling coefficient generated by the CABC unit, and outputting the first backlight controlling coefficient and the second backlight controlling coefficient to a backlight module to control a displayed image executed by the processing module further includes: adopting a product of the adjusted first backlight controlling coefficient and the second backlight controlling coefficient generated by the CABC unit to be a third backlight controlling coefficient; determining whether the third backlight controlling coefficient is smaller than 100%; outputting the PWM signals having the duty cycle ratio equaling to the third backlight controlling coefficient to the backlight module upon determining the third backlight controlling coefficient is smaller than 100%; and outputting the PWM signals having the duty cycle ratio equaling to 100% to the backlight module upon determining the third backlight controlling coefficient is greater than 100%.

In view of the above, the method includes: obtaining an original enhanced coefficient corresponding to the original image frame in accordance with the saturation values of the original image frame, adjusting a first backlight controlling coefficient generated by a PWM unit in accordance with original enhanced coefficient, and weighting the adjusted first backlight controlling coefficient and a second backlight controlling coefficient generated by the CABC unit, and outputting the first backlight controlling coefficient and the second backlight controlling coefficient to a backlight module to control a displayed image. In this way, the backlight brightness outputted by the backlight module may be adjusted in accordance with the saturation values of the original image frame so as to enhance the low brightness issue when a pure-color image is displayed by the display panel configured with RGBW sub-pixels.

DETAILED DESCRIPTION OF THE EMBODIMENTS

Embodiments of the invention will now be described more fully hereinafter with reference to the accompanying drawings, in which embodiments of the invention are shown.

Figure 1:
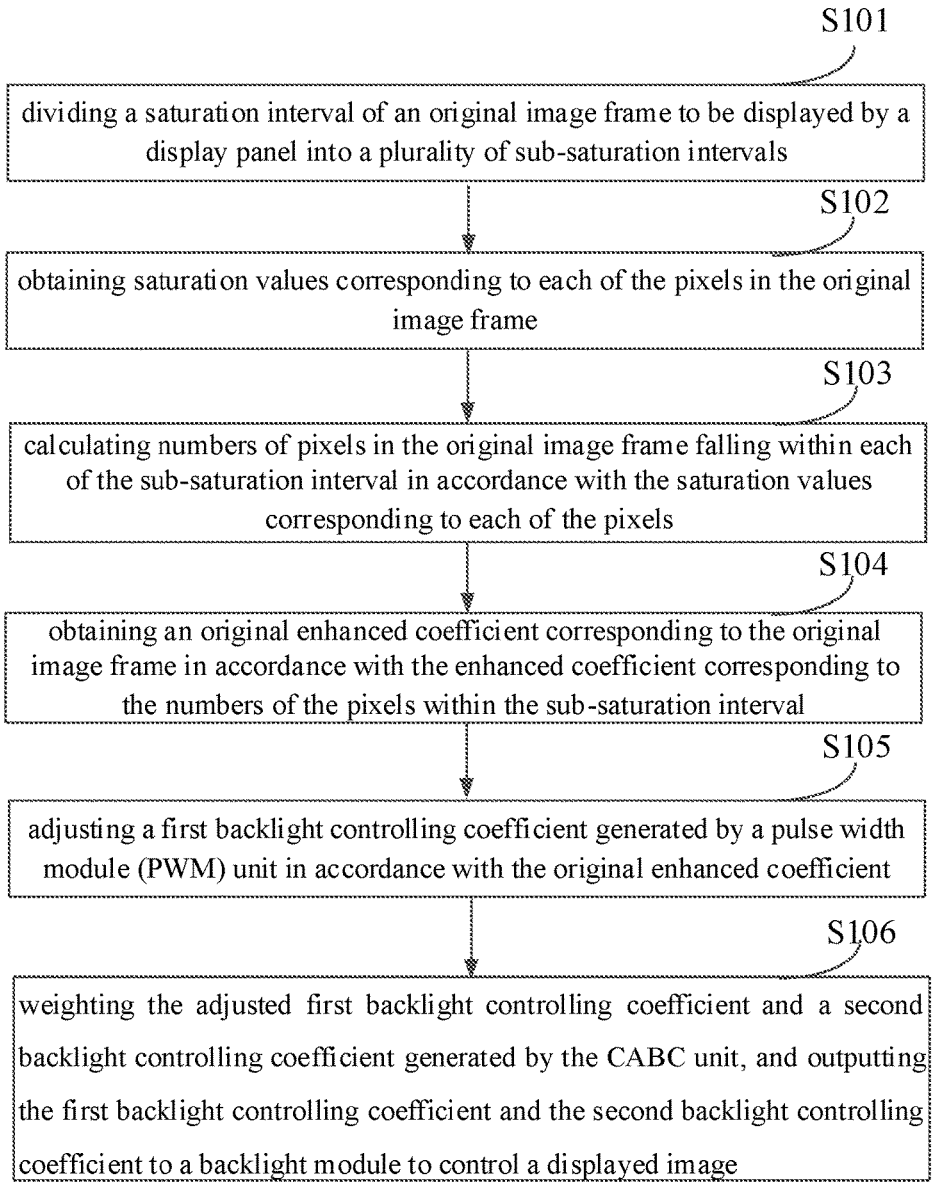
FIG. 1 is a flowchart illustrating the driving method in accordance with one embodiment.

FIG. 1 is a flowchart illustrating the driving method in accordance with one embodiment. The method includes the following steps.

In step S101, dividing a saturation interval of an original image frame to be displayed by a display panel into a plurality of sub-saturation intervals.

In step S101, the interval of the original image frame starting from zero to one is divided into, for instance, 8 sub-saturation intervals, wherein the number of the sub-saturation intervals may be determined in accordance with real scenarios.

In step S102, obtaining saturation values corresponding to each of the pixels in the original image frame.

In step S102, the step of obtaining saturation values corresponding to each of the pixels in the original image frame further includes: obtaining the three-color sub-pixel data of each of the pixels of the original image frame, and obtaining the saturation values corresponding to each of the pixels in accordance with the three-color sub-pixel data of each of the pixels.

Wherein the saturation value corresponding to each of the pixels may be calculated in accordance with the equation below:

$$s = \frac{\mathrm{Max}(R1, G1, B1) - \mathrm{Min}(R1, G1, B1)}{\mathrm{Max}(R1, G1, B1)};$$

Wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

In step S103, calculating numbers of pixels in the original image frame falling within each of the sub-saturation intervals in accordance with the saturation values corresponding to each of the pixels.

In step S103, in an example, the saturation interval of the original image frame is divided into eight sub-saturation intervals, which are respectively denoted as the first sub-saturation interval (S1), the second sub-saturation interval (S2) . . . , the eighth sub-saturation intervals (S8). The saturation values of each of the pixels of the original image frame fall within eight different sub-saturation intervals, and the numbers of the pixels within each of the sub-saturation intervals are calculated.

In the embodiment, "m" represents a total number of the pixels, "n1" represents the number of pixels within the first sub-saturation interval (S1), "n2" represents the number of pixels within the second sub-saturation interval (S2), . . . , and "n8" represents the number of pixels within the eighth sub-saturation interval (S8), and wherein m=m=n1+n2+. . . +n8.

In step S104, obtaining an original enhanced coefficient corresponding to the original image frame in accordance with the enhanced coefficient corresponding to the numbers of the pixels within the sub-saturation interval.

In step S104, the step of obtaining an original enhanced coefficient corresponding to the original image frame in accordance with the enhanced coefficient corresponding to the number of the pixels within the sub-saturation intervals further includes adopting the enhanced coefficient corresponding to the sub-saturation interval having the greatest number of pixels as the original enhanced coefficient.

Figure 2:
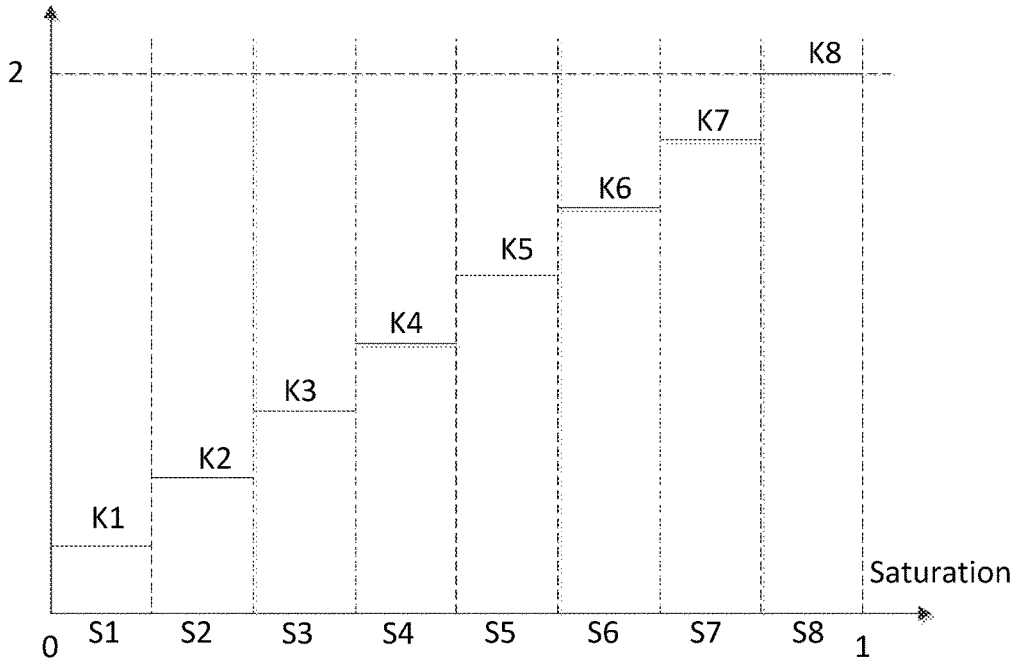
FIG. 2 is a schematic view of the relationship between the enhanced coefficient and the saturation value in accordance with one embodiment.

FIG. 2 is a schematic view of the relationship between the enhanced coefficient and the saturation value in accordance with one embodiment. As shown in FIG. 2, the x-axis ("Saturation") shows the saturation values, and the y-axis (Gain) shows the enhanced coefficient.

The first enhanced coefficient (K1) corresponds to the first sub-saturation interval (S1), the second enhanced coefficient (K2) corresponds to the second sub-saturation interval (S2), . . . , the eighth enhanced coefficient (K8) corresponds to the eighth sub-saturation interval (S8).

As shown in FIG. 2, the enhanced coefficient corresponding to the sub-saturation intervals increases along with the saturation value of the sub-saturation interval. That is, the second enhanced coefficient (K2) is greater than the first enhanced coefficient (K1), the third enhanced coefficient (K3) is greater than the second enhanced coefficient (K2), . . . , and the eighth enhanced coefficient (K8) is greater than the seventh enhanced coefficient (K7).

When the saturation interval ranges from zero to one, S1 ranges from 0 to ⅛, S2 ranges from ⅛ to ⅜, . . . , and S8 ranges from ⅞ to one. When the saturation interval ranges from zero to two, K1 is ¼, K2 is ¾, . . . , and K8 is two.

In an example, if the number of the pixels (n2) falling within the second sub-saturation interval (S2) is the maximum one, the original enhanced coefficient is K2.

In other embodiments, the step of obtaining an original enhanced coefficient corresponding to the original image frame in accordance with the enhanced coefficient corresponding to the number of the pixels and the sub-saturation interval further includes: obtaining a weight corresponding to each of the sub-saturation intervals in accordance with the number of pixels falling within each of the sub-saturation intervals; and obtaining the original enhanced coefficient in accordance with the weight and the enhanced coefficient corresponding to each of the sub-saturation intervals, wherein the weight corresponding to each of the sub-saturation intervals relates to a ratio of the number of the pixels falling within the respective sub-saturation intervals and the total number of the pixels.

Specifically, the original enhanced coefficient may be calculated in accordance with the equation:

$$K0=n1/m*K1+n2/m*K2+\ldots+n8/m*K8$$

Wherein K0 is the original enhanced coefficient, and n1, n2, . . . , n8 respectively relates to the number of the pixels falling within the first sub-saturation interval (S1), the second sub-saturation interval (S2), . . . , eighth sub-saturation interval (S8), m represents the total number of pixels, and K1, K2, . . . , K8 respectively represents the enhanced coefficients corresponding to the first sub-saturation interval (S1), the second sub-saturation interval (S2), . . . , the eighth sub-saturation interval (S8).

In step S105, adjusting a first backlight controlling coefficient generated by a PWM unit in accordance with the original enhanced coefficient.

In step S105, the first backlight controlling coefficient is configured to control the PWM unit to generate PWM signals having a duty cycle ratio equaling to the first backlight controlling coefficient.

It can be understood that when the first backlight controlling coefficient equals to one, there is no PWM unit configured.

In the embodiment, the adjusted first backlight controlling coefficient satisfies the equation below:

$$PWM1=PWM0*K0;$$

Wherein PWM1 relates to the adjusted first backlight controlling coefficient, PWM0 relates to the first backlight controlling coefficient before being adjusted, and K0 relates to the original enhanced coefficient.

It can be understood that the original enhanced coefficient (K0) ranges from zero to two such that the adjusted first backlight controlling coefficient is greater than one.

In step S106, weighting the adjusted first backlight controlling coefficient and a second backlight controlling coefficient generated by the CABC unit, and outputting the first backlight controlling coefficient and the second backlight controlling coefficient to a backlight module to control a displayed image.

In step S106, the step of weighting the adjusted first backlight controlling coefficient and a second backlight controlling coefficient generated by the CABC unit, and outputting the first backlight controlling coefficient and the second backlight controlling coefficient to a backlight module to control a displayed image further includes: adopting a product of the adjusted first backlight controlling coefficient and the second backlight controlling coefficient generated by the CABC unit to be a third backlight controlling coefficient; determining whether the third backlight controlling coefficient is smaller than 100%, outputting the PWM signals having the duty cycle ratio equaling to the third backlight controlling coefficient to the backlight module upon determining the third backlight controlling coefficient is smaller than 100%; and outputting the PWM signals having the duty cycle ratio equaling to 100% to the backlight module.

That is, the third backlight controlling coefficient satisfies the equation:

$$PWM3=PWM1*PWM2;$$

Wherein PWM1 relates to the adjusted first backlight controlling coefficient, PWM2 relates to the second backlight controlling coefficient generated by the CABC unit, and PWM3 relates to the third backlight controlling coefficient outputted to the backlight module.

It can be understood that the second backlight controlling coefficient is configured to control the CABC unit to generate the PWM signals having the duty cycle ratio equaling to the second backlight controlling coefficient, and the third backlight controlling coefficient is configured to control the backlight module to control the backlight module to generate the PWM signals having the duty cycle ratio equaling to the third backlight controlling coefficient. In addition, as the adjusted first backlight controlling coefficient (PWM1) is greater than one, the third backlight controlling coefficient (PWM3) is greater than one. At this moment, the PWM signals having the duty cycle ratio equaling to 100% controls the backlight module to output the maximum backlight brightness.

Figure 3:
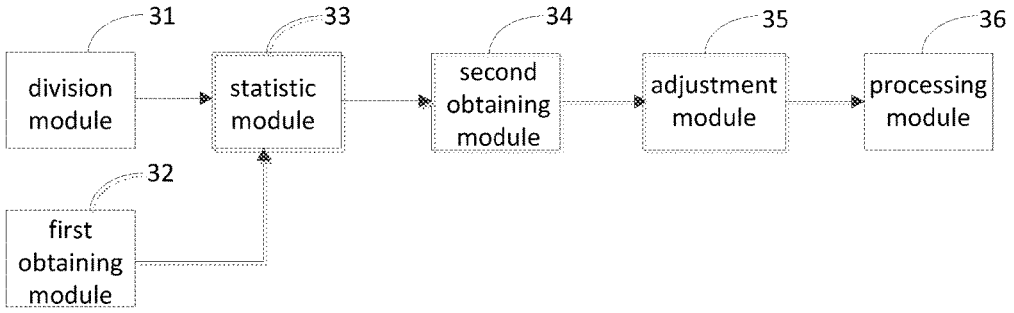
FIG. 3 is a schematic view of the driving device of the display panel in accordance with one embodiment.

FIG. 3 is a schematic view of the driving device of the display panel in accordance with one embodiment. The driving device includes a division module 31, a first obtaining module 32, a statistic module 33, a second obtaining module 34, an adjustment module 35, and a processing module 36.

The division module 31 is configured to divide a saturation interval of an original image frame to be displayed by a display panel into a plurality of sub-saturation intervals.

The first obtaining module 32 is configured to obtain saturation values corresponding to each of the pixels in the original image frame.

Specifically, the saturation values corresponding to each of the pixels may be calculated by the equation:

$$s=\frac{\mathrm{Max}(R1,G1,B1)-\mathrm{Min}(R1,G1,B1)}{\mathrm{Max}(R1,G1,B1)}$$

Wherein s represents the saturation value, R1, G1, B1 respectively represent the red grayscale value, the green grayscale value, and the blue grayscale value of the three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

The statistic module 33 connects to the division module 31 and the first obtaining module 32, and the statistic module 33 is configured to calculate numbers of the pixels in the original image frame falling within each of the sub-saturation intervals in accordance with the saturation values corresponding to each of the pixels.

The second obtaining module 34 connects to the statistic module 33, and the second obtaining module 34 is configured to obtain an original enhanced coefficient corresponding to the original image frame in accordance with the enhanced coefficient corresponding to the numbers of the pixels within the sub-saturation intervals.

In the embodiment, the step of obtaining an original enhanced coefficient corresponding to the original image frame in accordance with the enhanced coefficient corresponding to the number of the pixels within the sub-saturation intervals executed by the second obtaining module 34 further includes adopting the enhanced coefficient corresponding to the sub-saturation interval having the greatest number of pixels as the original enhanced coefficient.

In other embodiments, the step of obtaining an original enhanced coefficient corresponding to the original image frame in accordance with the enhanced coefficient corresponding to the number of the pixels within the sub-saturation intervals executed by the second obtaining module 34 further includes: obtaining a weight corresponding to each of the sub-saturation intervals in accordance with the number of pixels falling within each of the sub-saturation intervals; and obtaining the original enhanced coefficient in accordance with the weight and the enhanced coefficient corresponding to each of the sub-saturation intervals, wherein the weight corresponding to each of the sub-saturation intervals relates to a ratio of the number of the pixels falling within the respective sub-saturation intervals and the total number of the pixels.

The adjustment module 35 connects to the second obtaining module 34, and the adjustment module 35 is configured to adjust a first backlight controlling coefficient generated by a PWM unit in accordance with original enhanced coefficient obtained by the second obtaining module 34.

The processing module 36 connects to the adjustment module 35, and the processing module 36 is configured to weight the adjusted first backlight controlling coefficient and a second backlight controlling coefficient generated by the CABC unit, and output the first backlight controlling coefficient and the second backlight controlling coefficient to a backlight module to control a displayed image.

Specifically, the step of weighting the adjusted first backlight controlling coefficient and a second backlight controlling coefficient generated by the CABC unit, and outputting the first backlight controlling coefficient and the second backlight controlling coefficient to a backlight module to control a displayed image executed by the processing module 36 further includes: adopting a product of the adjusted first backlight controlling coefficient and the second backlight controlling coefficient generated by the CABC unit to be a third backlight controlling coefficient; determining whether the third backlight controlling coefficient is smaller than 100%, outputting the PWM signals having the duty cycle ratio equaling to the third backlight controlling coefficient to the backlight module upon determining the third backlight controlling coefficient is smaller than 100%; and outputting the PWM signals having the duty cycle ratio equaling to 100% to the backlight module upon determining the third backlight controlling coefficient is greater than 100%.

In view of the above, the method includes: obtaining an original enhanced coefficient corresponding to the original image frame in accordance with the saturation values of the original image frame, adjusting a first backlight controlling coefficient generated by a PWM unit in accordance with original enhanced coefficient, and weighting the adjusted first backlight controlling coefficient and a second backlight controlling coefficient generated by the CABC unit, and outputting the first backlight controlling coefficient and the second backlight controlling coefficient to a backlight module to control a displayed image. In this way, the backlight brightness outputted by the backlight module may be adjusted in accordance with the saturation values of the original image frame so as to enhance the low brightness issue when a pure-color image is displayed by the display panel configured with RGBW sub-pixels.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving method of a display panel, comprising:

dividing a saturation interval of an original image frame to be displayed by the display panel into a plurality of sub-saturation intervals;

obtaining saturation values corresponding to each of the pixels in the original image frame;

calculating numbers of pixels in the original image frame falling within each of the sub-saturation intervals in accordance with the saturation values corresponding to each of the pixels;

adopting an enhanced coefficient corresponding to the sub-saturation interval having the greatest number of pixels as an original enhanced coefficient; and adjusting backlight brightness of the display panel based on the original enhanced coefficient.

2. The method of claim 1, wherein the step of adjusting backlight brightness of the display panel based on the original enhanced coefficient comprises:

adjusting a first backlight controlling coefficient generated by a pulse width module (PWM) unit in accordance with the original enhanced coefficient;

adopting a product of the adjusted first backlight controlling coefficient and a second backlight controlling coefficient generated by a Content Adaptive Brightness Control (CABC) unit to be a third backlight controlling coefficient;

determining whether the third backlight controlling coefficient is smaller than 100%;

outputting PWM signals having a duty cycle ratio equaling to the third backlight controlling coefficient to a backlight module of the display panel when it is determined that the third backlight controlling coefficient is smaller than 100%; and outputting PWM signals having a duty cycle ratio equaling to 100% to the backlight module of the display panel when it is determined that the third backlight controlling coefficient is greater than 100%.

3. The method of claim 1, wherein the step of obtaining the saturation values corresponding to each of the pixels in the original image frame comprises:

calculating the saturation value corresponding to each of the pixels in accordance with the equation:

$$s = \frac{\mathrm{Max}(R1, G1, B1) - \mathrm{Min}(R1, G1, B1)}{\mathrm{Max}(R1, G1, B1)};$$

wherein s represents the saturation value, R1, G1, B1 respectively represent a red grayscale value, a green grayscale value, and a blue grayscale value of a three-color sub-pixel data of each of the pixels, Max (R1, G1, B1) is the maximum value among the red grayscale value (R1), the green grayscale value (G1), and the blue grayscale value (B1), and Min (R1, G1, B1) is the minimum value among the red grayscale value (R1), the green grayscale value (G1), and the blue grayscale value (B1).

* * * * *